US011976880B2

(12) United States Patent
Lochner

(10) Patent No.: US 11,976,880 B2
(45) Date of Patent: May 7, 2024

(54) METHOD AND INSTALLATION FOR LOW TEMPERATURE SEPARATION OF AIR

(71) Applicant: Linde GmbH, Pullach (DE)

(72) Inventor: Stefan Lochner, Grafing (DE)

(73) Assignee: Linde GmbH, Pullach (DE)

( * ) Notice: Subject to any disclaimer, the term of this patent is extended or adjusted under 35 U.S.C. 154(b) by 602 days.

(21) Appl. No.: 17/269,121

(22) PCT Filed: Aug. 20, 2019

(86) PCT No.: PCT/EP2019/025276
§ 371 (c)(1),
(2) Date: Feb. 17, 2021

(87) PCT Pub. No.: WO2020/038607
PCT Pub. Date: Feb. 27, 2020

(65) Prior Publication Data

US 2021/0325108 A1 Oct. 21, 2021

(30) Foreign Application Priority Data

Aug. 22, 2018 (EP) ..... 18020401

(51) Int. Cl.
*F25J 3/04* (2006.01)

(52) U.S. Cl.
CPC ..... *F25J 3/04678* (2013.01); *F25J 3/04412* (2013.01); *F25J 3/04878* (2013.01); *F25J 3/0489* (2013.01)

(58) Field of Classification Search
CPC .. F25J 3/04678; F25J 3/04412; F25J 3/04878; F25J 3/0489; F25J 2215/58; F25J 3/04648; F25J 3/0466
See application file for complete search history.

(56) References Cited

U.S. PATENT DOCUMENTS 5,311,744 A * 5/1994 Sweeney ..... F25J 3/04878 62/646
5,339,648 A 8/1994 Lockett et al.
(Continued)

FOREIGN PATENT DOCUMENTS

EP 0870524 A1 10/1998
FR 2739438 A1 4/1997
(Continued)

OTHER PUBLICATIONS

Dr. Heinz-Wolfgang Häring, "Industrial Gases Processing", book, Dec. 12, 2007, section 2.2.5, "Cryogenic Rectification.", Wiley-VCH Verlag Gmbh & Co. KGaA.

*Primary Examiner* — Schyler S Sanks
(74) *Attorney, Agent, or Firm* — Millen, White, Zelano & Branigan, P.C.; Brion P. Heaney

(57) ABSTRACT

A method for low temperature separation of air using an air separating installation having a distillation column system which has a first, a second, a third and a fourth separating unit. Compressed and cooled air is fed into the first separating unit. An oxygen-enriched, nitrogen-depleted, argon-containing first sump liquid and a nitrogen-enriched, oxygen-depleted first head gas are formed by means of the first separating unit. An oxygen-rich second sump liquid and an argon-enriched second head gas are formed by means of the second separating unit. A liquid return to the second separating unit is provided by means of the third separating unit. A fourth sump liquid and a fourth head gas are formed by means of the fourth separating unit, and the fourth sump liquid is at least partially returned to the second separating unit.

22 Claims, 1 Drawing Sheet

(56) References Cited

U.S. PATENT DOCUMENTS

| | | | | |
|---|---|---|---|---|
| 2015/0096327 | A1 | 4/2015 | Lochner et al. | |
| 2015/0369535 | A1* | 12/2015 | Lochner | F25J 3/04654 62/644 |

FOREIGN PATENT DOCUMENTS

| | | | |
|---|---|---|---|
| WO | 2014135271 | A2 | 9/2014 |
| WO | 2016146246 | A1 | 9/2016 |

* cited by examiner

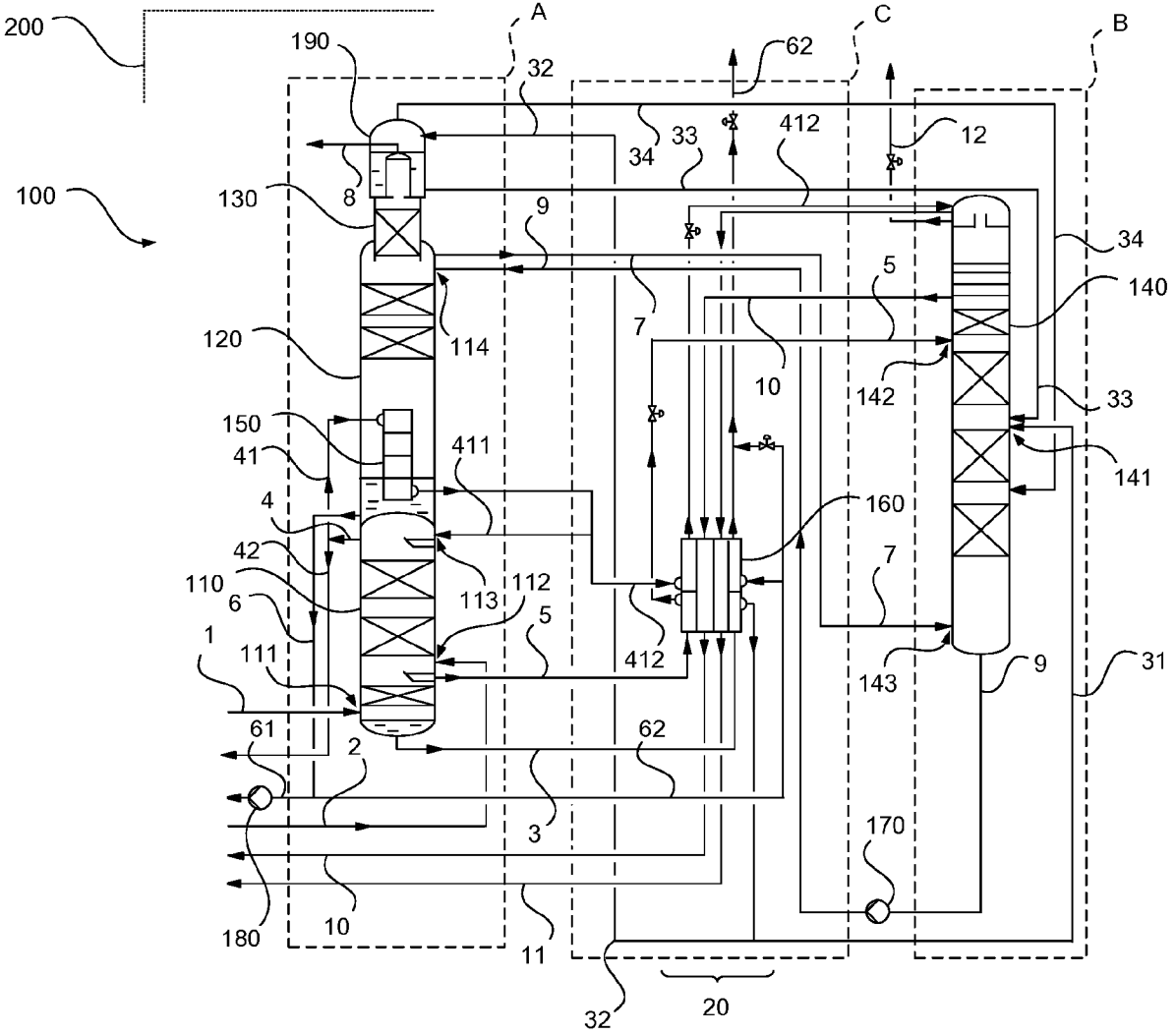
A
B
C
1
2
3
4
5
6
7
8
9
10
11
12
20
31
32
33
34
41
42
61
62
110
111
112
113
114
120
130
140
141
142
143
150
160
170
180
190
200
100
411
412

METHOD AND INSTALLATION FOR LOW TEMPERATURE SEPARATION OF AIR

The invention relates to a method for low temperature separation of air and to a corresponding installation in accordance with the preambles of the independent claims.

PRIOR ART

The production of air products in the liquid or gaseous state by low temperature separation of air in air separating installations is known and is described, for example, in H.-W. Haring (editor), Industrial Gases Processing, Wiley-VCH, 2006, in particular section 2.2.5, "Cryogenic Rectification."

Air separating installations have distillation column systems which can be designed, for example, as two-column systems, in particular as classical Linde double-column systems, but also as three-column or multi-column systems. In addition to the distillation columns for extracting nitrogen and/or oxygen in the liquid and/or gaseous state, i.e., the distillation columns for nitrogen-oxygen separation, distillation columns for extracting further air components, in particular the noble gases krypton, xenon, and/or argon, can be provided.

The distillation columns of the distillation column systems mentioned are operated at different pressure levels. Known double-column systems have what is known as a high-pressure column (also referred to as a pressure column, medium-pressure column, or lower column) and what is known as a low-pressure column (also referred to as an upper column). The high-pressure column is typically operated at a pressure level of 4 to 7 bar, in particular approximately 5.3 bar. The low-pressure column is operated at a pressure level of typically 1 to 2 bar, in particular approximately 1.4 bar. In certain cases, higher pressure levels may also be used in the low-pressure column. The pressures indicated here and in the following are absolute pressures at the head of the columns indicated in each case.

In known methods and installations for low temperature separation of air, an oxygen-enriched, nitrogen-depleted liquid is formed in a lower region of the high-pressure column and withdrawn from the high-pressure column. This liquid, which in particular also contains argon, is at least partially fed into the low-pressure column and further separated there. Before being fed into the low-pressure column, it can be partially or completely evaporated, wherein optionally evaporated and unevaporated fractions can be fed into the low-pressure column at different positions.

The present invention is based on a method and a corresponding installation in which a high-pressure and a low-pressure column are used. In the context of the present invention, however, the low-pressure column is not designed in one piece but is divided into a first section and a second section, wherein the first and the second section are arranged at different positions of the air separating installation and at different heights and in particular do not project onto one another in a plan view onto a column longitudinal axis. However, the first and the second section of the low-pressure column are operated at a common pressure level within the context of the present invention. The low-pressure column, which is divided into two sections, used in the context of the present invention thus differs from likewise known arrangements in which, in addition to the high-pressure and the low-pressure column, a further column is provided for separating nitrogen and oxygen and is operated, however, at a pressure level which is between the pressure levels at which the high-pressure column and the low-pressure column are operated.

In order to extract argon, air separating installations with crude and pure argon columns can be used. An example is illustrated in Haring (see above) in FIG. 2.3A and described starting on page 26 in the section "Rectification in the Low-pressure, Crude and Pure Argon Column" and also starting on page 29 in the section "Cryogenic Production of Pure Argon." As explained there, argon accumulates in corresponding installations at a certain height in the low-pressure column. At this or at another favorable point, optionally also below the argon maximum, known as the argon transition, argon-enriched gas with an argon concentration of typically 5 to 15 mole percent can be withdrawn from the low-pressure column and transferred into the crude argon column. A corresponding gas typically contains about 100 ppm of nitrogen and otherwise substantially oxygen.

The crude argon column serves substantially to separate off the oxygen from the gas withdrawn from the low-pressure column. The oxygen separated off in the crude argon column or a corresponding oxygen-rich fluid can be returned to the low-pressure column in liquid form. The oxygen or the oxygen-rich fluid is typically fed into the low-pressure column several theoretical or practical plates below the feed point for the oxygen-enriched, nitrogen-depleted, and optionally partially or completely evaporated liquid withdrawn from the high-pressure column. A gaseous fraction which remains in the crude argon column during the separation and contains substantially argon and nitrogen is further separated in the pure argon column to obtain pure argon. The crude and the pure argon column have head condensers which can be cooled in particular with a part of the oxygen-enriched, nitrogen-depleted liquid withdrawn from the high-pressure column, which partially evaporates during this cooling. Other fluids can also be used for cooling.

In principle, a pure argon column can also be dispensed with in corresponding installations, wherein it is typically ensured here that the nitrogen content at the argon transition is below 1 ppm. Argon of the same quality as from a conventional pure argon column is in this case withdrawn from the crude argon column slightly further down than the fluid conventionally transferred into the pure argon column, wherein the plates in the section between the crude argon condenser, i.e., the head condenser of the crude argon column, and a corresponding withdrawal serve as barrier plates for nitrogen.

As set out in Haring (see above) with reference to FIG. 2.4A, although argon is contained in atmospheric air with a content of less than 1 mole percent, it exerts a strong influence on the concentration profile in the low-pressure column. The separation in the lowermost separating section of the low-pressure column, which typically comprises 30 to 40 theoretical or practical plates, can thus be regarded as a substantially binary separation between oxygen and argon. Only starting at the discharge point for the gas transferred into the crude argon column, the separation changes within a few theoretical or practical plates into a ternary separation of nitrogen, oxygen, and argon.

It can therefore prove advantageous to discharge argon from the low-pressure column even in a corresponding installation or a corresponding method no argon extraction should occur. As mentioned, when a crude argon column is used, a corresponding argon discharge takes place because argon-enriched gas is transferred from the low-pressure column into the crude argon column, but substantially only the oxygen contained in this gas is returned to the low-pressure column. However, the argon discharged with a correspondingly removed gas is permanently drawn off from the low-pressure column.

An "argon discharge" is generally understood here to mean a measure in which an argon-containing fluid is transferred from the low-pressure column into a further separating unit and, after depletion of argon, is partially or completely returned from the further separating unit to the low-pressure column. The classical type of argon discharge consists in the use of a crude argon column. However, argon discharge columns explained below can also be used.

The advantageous effect of the argon discharge is attributable to the fact that the separation of oxygen and argon is no longer necessary in the low-pressure column for the amount of argon discharged, but that this binary separation can be relocated out of the low-pressure column. The separation of oxygen and argon in the low-pressure column itself is in principle complex and requires a corresponding "heating" power of the main condenser. By discharging argon from the low-pressure column, the heating power of the main condenser can be reduced. Thus, for example, with a constant yield of oxygen, either more air can be blown into the low-pressure column or more pressurized nitrogen can be removed from the high-pressure column, which in turn can each provide energetic advantages.

In a conventional crude argon column, as explained, crude argon is extracted and processed in a downstream pure argon column to form pure argon. An argon discharge column, however, primarily serves to discharge argon for the purpose explained of improving the separation in the low-pressure column. In principle, an "argon discharge column" can be understood here to mean a separating column for separating oxygen and argon, which is not used to extract a pure argon product but substantially to discharge argon from the low-pressure column.

The structure of an argon discharge column differs fundamentally only slightly from that of a classical crude argon column. However, an argon discharge column typically contains significantly fewer theoretical or practical plates, namely, less than 40, in particular between 15 and 30. For further values for the number of plates, reference is made to the statements below. As with a conventional crude argon column, conventionally in particular the sump region of an argon discharge column can be connected to an intermediate point in the low-pressure column. An argon discharge column can be cooled in particular by means of a head condenser in which the oxygen-enriched, nitrogen-depleted liquid withdrawn from the high-pressure column is partially evaporated. An argon discharge column typically does not have a sump evaporator. The present invention uses an argon discharge column arranged in the manner explained below.

U.S. Pat. No. 5,339,648 A discloses an air separating installation with a high-pressure column and a low-pressure column which is vertically divided in one section. A partial region of the low-pressure column thereby formed in the section can be used for argon discharge. According to U.S. Pat. No. 5,311,744 A, a complete argon column is located on the high-pressure column. Below the argon column is a further separating section, above which fluid is withdrawn and fed into a nitrogen stripping column. FR 2 739 438 A1 discloses a distillation column system with a two-part low-pressure column, wherein an argon column is located next to this arrangement.

The object of the present invention is to improve the low temperature separation of air using argon discharge columns and, in particular, to make the arrangement of the distillation columns used more advantageous.

DISCLOSURE OF THE INVENTION

Against this background, the present invention proposes a method for low temperature separation of air and a corresponding installation with the features of the respective independent claims. Embodiments are the subject matter of the dependent claims respectively and of the description below.

Prior to explaining the features and advantages of the present invention, some of the principles of the present invention are explained in greater detail and terms used below are defined.

The devices used in an air separating installation are described in the cited technical literature, for example in Haring (see above) in section 2.2.5.6, "Apparatus." Unless the following definitions differ, reference is therefore explicitly made to the cited technical literature for the purpose of terminology used in the context of the present application.

Liquids and gases may, in the terminology used herein, be rich or low in one or more components, wherein "rich" can refer to a content of at least 50%, 75%, 90%, 95%, 99%, 99.5%, 99.9%, or 99.99%, and "low" can refer to a content of at most 50%, 25%, 10%, 5%, 1%, 0.1%, or 0.01% on a mole, weight, or volume basis. The term "predominantly" may correspond to the definition of "rich." Liquids and gases may also be enriched in or depleted of one or more components, wherein these terms refer to a content in a starting liquid or a starting gas from which the liquid or gas has been extracted. The liquid or the gas is "enriched" if it contains at least 1.1 times, 1.5 times, 2 times, 5 times, 10 times, 100 times, or 1,000 times the content, and "depleted" if it contains at most 0.9 times, 0.5 times, 0.1 times, 0.01 times, or 0.001 times the content of a corresponding component, based on the starting liquid or the starting gas. If, by way of example, reference is made here to "oxygen," "nitrogen," or "argon," this is also understood to mean a liquid or a gas which is rich in oxygen or nitrogen but need not necessarily consist exclusively of it.

The present application uses the terms "pressure level" and "temperature level" to characterize pressures and temperatures, which means that corresponding pressures and temperatures in a corresponding installation do not have to be used in the form of exact pressure or temperature values in order to realize the inventive concept. However, such pressures and temperatures typically fall within certain ranges that are, for example, ±1%, 5%, or 10% around an average. In this case, corresponding pressure levels and temperature levels can be in disjointed ranges or in ranges which overlap one another. In particular, pressure levels, for example, include unavoidable or expected pressure losses. The same applies to temperature levels. The pressure levels indicated here in bar are absolute pressures.

The high-pressure column and the low-pressure column (or, in the context of the present invention, their first section) of an air separating installation are in heat-exchanging connection via what is known as a main condenser. In particular, the main condenser can be arranged in a lower (sump) region of the low-pressure column (or, here, of its first section). In this case, it is known as an internal main condenser and the evaporation chamber of the main condenser is at the same time the interior of the low-pressure column (or of its first section). However, the main condenser can basically be arranged outside the interior of the high-pressure column, meaning what is known as an external main condenser.

The main condenser and the head condenser of an argon discharge column used in the context of the present invention may each be designed as a condenser evaporator. A "condenser evaporator" refers to a heat exchanger in which a first, condensing fluid stream enters into indirect heat exchange with a second, evaporating fluid stream. Each condenser evaporator has a liquefaction chamber and an evaporation chamber, which have liquefaction and evaporation passages, respectively. The condensation (liquefaction) of the first fluid stream is performed in the liquefaction chamber, and the evaporation of the second fluid stream is performed in the evaporation chamber. The evaporation and liquefaction chambers are formed by groups of passages which are in a heat exchange relationship with one another. The main condenser can be designed in particular as a single-level or multi-level bath evaporator, in particular as a cascade evaporator (as described, for example, in EP 1 287 302 B1) or as a falling film evaporator. It can be formed by a single heat exchanger block or by a plurality of heat exchanger blocks arranged in a common pressure vessel. However, the present invention is expressly not limited to corresponding types of condenser evaporators or condensers.

A distillation column system of an air separating installation is arranged in one or more cold boxes. A "cold box" is understood here to mean an insulating cover which completely envelops a heat-insulated interior, apart from feedthroughs for lines and the like, with outer walls. Installation parts to be insulated, e.g., one or more distillation columns and/or heat exchangers, are arranged in the interior. The insulating effect can be brought about by correspondingly designing the outer walls and/or by filling the gap between installation parts and outer walls with an insulating material. In the latter variant, a pulverulent material, such as perlite, is preferably used. Both the distillation column system of an installation for low temperature separation of air and the main heat exchanger and further cold installation parts are enclosed by one or more cold boxes in customary air separating installations. The outer dimensions of the cold box usually determine the transport dimensions in prefabricated installations.

A "main heat exchanger" of an air separating installation serves to cool feed air in indirect heat exchange with return flows from the distillation column system. It can be formed from one or more heat exchanger sections connected in parallel and/or serially, e.g., from one or more plate heat exchanger blocks. Separate heat exchangers that serve especially for evaporation or pseudoevaporation of a single liquid or supercritical fluid without heating and/or evaporation of another fluid are not part of the main heat exchanger.

In the case of a "supercooler" or "supercooling counterflow heat exchanger" (the two terms are used completely interchangeably with one another in the following), the terminology used here means a heat exchanger by means of which gaseous and liquid streams of material in an air separating installation are subjected to heat exchange with one another, which streams of material are removed from the rectification column system and returned partially or completely to the rectification column system after the heat exchange.

The relative spatial terms "upper," "lower," "over," "under," "above," "below," "adjacent to," "next to," "vertical," "horizontal," etc. here refer to the spatial orientation of the distillation columns of an air separating installation in normal operation. An arrangement of two distillation columns or other components "one above the other" is understood here to mean that the upper end of the lower of the two apparatus parts is located at a lower geodetic height than or the same geodetic height as the lower end of the upper of the two apparatus parts and the projections of the two apparatus parts overlap in a horizontal plane. In particular, the two apparatus parts are arranged exactly one above the other, that is to say the axes of the two apparatus parts run on the same vertical straight line. In other cases, however, in particular if the apparatus parts have different diameters, it may also be advantageous not to arrange the axes one above the other, for example in order to arrange the apparatus part with the smaller diameter closer to a cold box wall.

Advantages of the Invention

The present invention is based on the finding that by arranging an argon discharge column in a distillation column system, having a two-part low-pressure column, of an air separating installation in a way that differs significantly from the prior art, an air separating method can be designed particularly efficiently and, in particular, a corresponding air separating installation can be created particularly simply and cost-effectively.

The advantages achievable in the context of the present invention include in particular a particularly advantageous ability of the respective components of a distillation column system, proposed according to the invention, to be arranged in different cold boxes, which makes it possible to prefabricate them and transport them prefabricated to the respective place of use even if argon discharge columns are used. However, the advantages of the present invention are not limited to the improved ability of the components to be arranged and transported in cold boxes, but in particular also comprise a simple creation of a corresponding air separating installation by dispensing with extensive piping, as is typically required in the case of a deviating conventional arrangement of an argon discharge column.

An essential aspect of a particularly preferred embodiment of the present invention consists in placing an argon discharge column with the underside in the open state onto the lower section of a corresponding two-part low-pressure column, in addition to the already mentioned division into two parts of the low-pressure column. Generally, the "lower" or "first" section of a two-part low-pressure column is understood to mean the section in the sump of which, as in the sump of a conventional one-part low-pressure column, an oxygen-rich liquid forms. In another preferred embodiment, however, the argon discharge column can also be connected via lines to the lower section of the two-part low-pressure column. In all embodiments of the present invention, the argon discharge column is arranged above the lower part of the low-pressure column.

In all cases, the lower or first section of a corresponding two-part low-pressure column can be connected as a structural unit to the high-pressure column. In particular, the main condenser connecting the high-pressure column and the low-pressure column in a heat-exchanging manner is also located in the first or lower section of the two-part low-pressure column. The "second" or "upper" section of the two-part low-pressure column, on the other hand, is the section in which a nitrogen-rich head gas forms on the head side, which head gas can be conducted out as a corresponding (low-pressure) nitrogen product. In particular, in the context of the present invention, the division into two parts of the low-pressure column is such that a maximum of the argon concentration results in an upper region or at the head of the first or lower section of the two-part low-pressure column, corresponding to the region of the maximum argon concentration in a conventional one-part low-pressure column. This is brought about in particular by a corresponding selection of the number of theoretical plates in the first part or lower section of the low-pressure column and by known structural measures.

As a result of the arrangement of the high-pressure column, the first section of the low-pressure column, and the argon discharge column proposed according to the invention, a correspondingly created structural unit can be introduced in particular into a still transportable cold box; therefore, a corresponding air separating installation can be prefabricated and, if necessary, a corresponding cold box can be brought to the respective place of use. The remaining components in the cold part of the air separating installation, i.e., in particular the second section of the low-pressure column and optionally a supercooling counter-flow heat exchanger, can be relocated to at least one second cold box which likewise typically does not exceed the maximum sizes for any transport to the place of use. A particularly advantageous embodiment of the present invention results when the second section of the low-pressure column is relocated to a cold box and the lines used for the piping of the separating units mentioned, in particular together with a supercooler, are relocated to a further cold box.

Overall, the present invention proposes a method for low temperature separation of air using an air separating installation having a distillation column system. In the context of the present invention, the distillation column system comprises a first separating unit (corresponding to the high-pressure column of a conventional air separating installation), a second separating unit (corresponding to the first or lower section of a two-part low-pressure column), a third separating unit (corresponding to the argon discharge column), and a fourth separating unit (corresponding to the second or upper section of a two-part low-pressure column). Compressed and cooled air is fed into the first separating unit but not necessarily only into it, in the context of the present invention. Corresponding air can be compressed by means of known measures, in particular using a main air compressor and optionally one or more secondary compressors, boosters, and the like. In the context of the present invention, it is prepared by means of likewise known measures, i.e., in particular freed of water and carbon dioxide. In the context of the present invention, different measures can be used for air preparation and cooling and for further treatment of this air. In particular, one or more expansion valves, boosters, turbines, and the like can also be used, as are generally known from the field of air separation. For details, reference is again made to the relevant technical literature, e.g., Haring (see above).

In the context of the present invention, the first separating unit is operated at a first pressure level of 4 to 9 bar, in particular 4 to 8 bar of absolute pressure, e.g., a pressure level of approximately 5.3 bar of absolute pressure, as corresponds to the normal operating pressure of a high-pressure column of an air separating installation. In contrast, in the context of the present invention, the second, the third, and the fourth separating units are operated at a common second pressure level, which in the context of the present invention is 1 to 3 bar, in particular 1 to 2 bar of absolute pressure, i.e., corresponds to the typical pressure level of a low-pressure column of an air separating installation. The second pressure level may be, for example, approximately 1.4 bar of absolute pressure.

In the context of the present invention, an oxygen-enriched, nitrogen-depleted, argon-containing first sump liquid and a nitrogen-enriched, oxygen-depleted first head gas are formed by means of the first separating unit, as is known in this respect for high-pressure columns of air separating installations. For further details, reference is also made here to relevant technical literature regarding air separation or the operation of high-pressure columns of known air separating installations.

In the context of the present invention, the first sump liquid is partially or completely transferred into the fourth separating unit and the first head gas is partially or completely liquefied and returned to the first separating unit. In particular, a main condenser, which in the present case connects the first separating unit and the second separating unit in a heat-exchanging manner, is used to liquefy the first head gas or the fraction of it that is returned to the first separating unit. Further details of a corresponding main condenser are explained below.

The present invention is not limited to liquefying only the fraction of the first head gas that is returned to the first separating unit. Rather, in the context of the present invention, further head gas may also be liquefied and, in particular, discharged as a product from the air separating installation as a liquid air product, without or with subsequent evaporation or conversion to the supercritical state. Furthermore, further liquefied head gas from the head of the first separating unit, i.e., liquefied first head gas, can be guided to the fourth separating unit as a return flow in the context of the present invention, in particular after corresponding liquefied head gas has previously been passed through a supercooling counter-flow heat exchanger. Non-liquefied head gas can also be withdrawn from the head of the first separating unit and be conducted out of the air separating installation, for example as a pressurized nitrogen product. As already explained, the use of an argon discharge column makes it possible, in particular, for the quantity of the head gas in the high-pressure column that is discharged from the air separating installation to be increased.

In the context of the present invention, an oxygen-rich second sump liquid and an argon-enriched second head gas are formed by means of the second separating unit. This can have, for example, an argon content of 5 to 15% and substantially oxygen in the remainder. As mentioned, in the context of the present invention, the second separating unit substantially corresponds to the lower section or first section of a two-part low-pressure column or the lower part of a classical one-part low-pressure column up to the argon maximum. As has likewise already been mentioned, this is achieved by the selection of corresponding separating means or the selection of the number of separating plates. A corresponding design of the second separating unit enables an advantageous argon discharge in the third separating unit.

For this purpose, in the context of the present invention, a first fraction of the second head gas is transferred into the third separating unit and a second fraction of the second head gas is transferred into the fourth separating unit. While the fourth separating unit corresponds to the conventional second or upper section of a two-part low-pressure column, the third separating unit is substantially provided to perform an argon discharge. As explained below, within the context of the present invention, the third separating unit can be designed as a structural unit together with the second separating unit. In this case, it is therefore not necessary to conduct corresponding fluid out of the low-pressure column and transfer it into an argon discharge column. Instead, in this embodiment, the second head gas is transferred into the third separating unit in particular in a deflection-free manner. In this embodiment, the transfer takes place in particular without lines.

By means of the third separating unit, at least the predominant part of the argon which is contained in a quantity of air supplied overall to the distillation column system is separated off, wherein a liquid return is generated by means of the third separating unit and is returned to the second separating unit. For this purpose, the third separating unit has separating zones which can be designed using known separating devices, in particular ordered or unordered packages or plates. For dimensioning the third separating unit, reference is made to the explanations below. In principle, the third separating unit can be designed in a known manner, wherein the third separating unit corresponds to an argon discharge column which, however, is open in the lower region with respect to the second separating unit.

In the context of the present invention, a fourth sump liquid and a fourth head gas are formed by means of the fourth separating unit, and the fourth sump liquid is partially or completely returned to the second separating unit. According to the invention, the fourth separating unit is arranged adjacent to the first (and thus optionally also the second) separating unit, for which reason, in particular, a suitable pump is used to transfer the fourth sump liquid to the second separating unit.

In the context of the present invention, it is provided in particular that the second separating unit, that is to say the first or lower section of the low-pressure column, has 10 to 50 theoretical plates, in particular 20 to 40 theoretical plates. In the context of the present invention, the third separating unit has 10 to 60 theoretical plates, in particular 15 to 30 theoretical plates. The second separating unit is therefore the section of a low-pressure column which comprises the typical oxygen section or corresponding separating devices of such an oxygen section. The third separating unit, however, is designed as an argon discharge column, as already explained several times. In particular, the third separating unit can have a diameter which is at most 80%, 70%, 60%, or 50% of a diameter of the second separating unit.

In the context of the present invention, it is furthermore provided that the third separating unit (in the sense of the explanations above) is arranged above the second separating unit, in particular exactly above it, and that the third separating unit opens in a lower region, in particular in an untapered manner, with respect to an upper region of the second separating unit or that the third separating unit is connected to the second separating unit via pipelines running between an upper region of the second separating unit and a lower region of the third separating unit. An "untapered" opening of the third separating unit is understood to mean that a column jacket of the third separating unit has no constriction with respect to a column jacket of the second separating unit. In particular, in the context of the present invention, in this embodiment there is no cross-sectional reduction with respect to a cross section of the third separating unit. In particular, however, as explained, the third separating unit may have a smaller cross section than the second separating unit, and the entire cross section of the third separating unit may be available for an inflow of the first fraction of the second head gas into the third separating unit. In contrast to conventional arrangements, in which an argon discharge column is arranged adjacent to the distillation column system formed from a high-pressure and a low-pressure column, no transfer of corresponding fluids by means of pumps, lines, and the like is therefore required in the context of the present invention, even if lines run between the upper region of the second separating unit and the lower region of the third separating unit in one embodiment. Rather, second head gas can rise in a substantially unimpeded manner out of the second separating unit into the third separating unit, and liquid from the third separating unit can flow off in a substantially unimpeded manner into the second separating unit. If the third separating unit opens in the lower region with respect to the upper region of the second separating unit, this can take place in particular without deflection or lines. This, too, as already mentioned, is a particular advantage of the present invention.

Simply for the sake of completeness, it should again be emphasized that the first and second separating units are also arranged one above the other in the context of the present invention, as is otherwise also evident from the explanations given above and below.

As is known in this respect for argon discharge columns, the argon discharge column used in the context of the present invention, that is to say the third separating unit, can also have a head condenser which can be cooled with oxygen-enriched liquid from the high-pressure column, i.e., here the first sump liquid. Corresponding liquid, which is partially evaporated during cooling, can then be fed into the fourth separating unit, in particular at different heights. Advantageously, the corresponding streams are divided outside of the head condenser so that they have different concentrations.

In the context of the present invention, as already mentioned, in particular falling film or cascade evaporators, in particular multi-level cascade evaporators of the type explained above, can be used as main condensers, that is to say as condensers which connect the first separating unit and the second separating unit to one another in a heat-exchanging manner. This results in a particularly efficient liquefaction in a corresponding main condenser. However, the present invention is explicitly not limited to such forms of condenser evaporators but can be used with any type of main condensers.

In the context of the present invention, the compressed and cooled air which is fed into the first separating unit can comprise in particular a gaseous and a liquefied feed air stream, each of which is fed into the first separating unit at the first pressure level. In this case, a gaseous feed air stream can be fed into the first separating unit at a first feed position and a liquid feed air stream can be fed into the first separating unit at a second feed position, wherein the first feed position is below the second feed position, wherein typically no separating devices are provided in the first separating unit below the first feed position, wherein the second feed position is advantageously above a liquid retention device from which a liquid stream of material can be withdrawn from the first separating unit, and wherein the second feed position is above a separating unit or separating region of the first separating device. It should be explicitly emphasized that, in the context of the present invention, feed air can also be fed, for example, two-phase in a common line into the first separating unit. The formation of corresponding streams of material is known in the field of air separation.

With particular advantage, in the context of the present invention, the first separating unit and the second separating unit are structurally connected to one another and can be arranged within a common column jacket, wherein the common column jacket can also be structurally connected to the third separating unit. A common column jacket in the sense of the present invention can in particular be a common cylindrical outer container so that the first separating unit and the second separating unit can be produced with the same cross section in the context of the present invention. If the high-pressure column or first separating unit has a smaller diameter than the first section of the low-pressure column or the second separating unit, no accommodation in a common column jacket is typically provided; the column jacket of the high-pressure column is attached to the underside of the column jacket of the base section of the low-pressure column. More generally, in this case, the first and the second separating unit thus have separate but interconnected column jackets. Different cross sections can thus also be used in principle. In particular, the third separating unit has a smaller cross section than the first and/or the second separating unit and therefore does not have to be arranged within this common cylindrical column jacket but is connected to the common column jacket of the first and second separating unit or the column jacket of the second separating unit, for example, welded to an opening in the upper region of the second separating unit, if the third separating unit opens in the lower region with respect to the upper region of the second separating unit. More generally, in this case, a line-less direct contact of the column jackets of the second and third separating units is provided. However, as mentioned, a connection via lines can also be provided.

The fourth separating unit is advantageously not structurally connected in such a way to the first, the second, and the third separating unit but is connected to the first, the second, and the third separating units only via piping or lines. In this way, the first, the second, and the third separating unit on the one hand and the fourth separating unit on the other hand can be arranged at different positions of a corresponding installation and in particular accommodated in different cold boxes. The fourth separating unit can also have a smaller, but also a larger, cross section than the second separating unit. In particular, it can have 18 to 65 theoretical plates and thus correspond to the rest of a corresponding two-part low-pressure column, the first section of which is formed by the second separating unit.

In the method proposed according to the invention, the first fraction of the second head gas has in particular 20 to 50 volume percent and the second fraction of the second head gas has 50 to 80 volume percent (i.e., in particular the rest) of the second head gas. In this way, a particularly efficient argon discharge in the third separating unit results in the context of the present invention.

As already mentioned, in the context of the present invention, the fourth separating unit is arranged adjacent to the first separating unit and in particular in a separate cold box. The overall height of a corresponding air separating installation is reduced overall in this way. In such an embodiment, it is provided, in particular, that the fourth sump liquid is returned to the second separating unit using a transfer pump or at least two transfer pumps arranged in parallel and is thereby guided to the second separating unit as a liquid return, in particular at the head of the second separating unit. In particular, two pumps can be operated in parallel and a third can be provided for redundancy reasons. The use of two transfer pumps arranged in parallel enables a particularly simple construction because standard pumps of corresponding sizes are available. A corresponding transfer pump is provided in order to overcome the difference in height between the second separating unit and the fourth separating unit or vice versa. In contrast, the second fraction of the second head gas can advantageously flow into the fourth separating unit due to a minimal pressure difference between the second separating unit and the fourth separating unit.

The fourth separating unit is arranged adjacent to the first separating unit in particular such that a lower termination of the fourth separating unit is arranged no more than eight meters, in particular no more than seven, six, or five meters, e.g., one to four meters, above a lower termination of the first separating unit. In this case, a "lower termination" is the part of the separating unit a column sump that delimits the column interior. However, lines can still lead out of this. The fourth separating unit is arranged, in particular, on a frame of said height in order to ensure a sufficient holding pressure level for the pump(s) used. Such an arrangement makes it possible to create a particularly compact air separating installation that is limited in its vertical extent.

As already mentioned several times, the first separating unit, the second separating unit, and the third separating unit are advantageously arranged in a common cold box and the fourth separating unit is arranged in a further cold box.

In the context of the present invention, the first separating unit, the second separating unit, and the third separating unit on the one hand and the fourth separating unit on the other hand are connected in particular to one another and/or to one another to further apparatuses by means of piping. At least a part of this piping can run vertically. In the context of the present invention, at least a part of such piping can be arranged separately from the two cold boxes, in which the first separating unit, the second separating unit, and the third separating unit on the one hand and the fourth separating unit on the other hand are arranged, in an additional cold box, here referred to a "piping cold box," which can be prefabricated. The provision of a corresponding piping cold box makes it possible to correspondingly reduce the dimensions of the other two cold boxes and in particular to make them (better) transportable. The piping cold box may also accommodate a majority of the instrumentation, valves, etc. It may contain, for example, at least 50, 60, 70, or 80% of the line length of the lines forming the piping. At the location where a corresponding air separating installation is created, the cold boxes are connected to one another and piping is therefore produced at the same time. It is particularly advantageous if a piping cold box also contains a supercooler or supercooling counter-flow heat exchanger provided in the air separating installation, which can be arranged in a particularly favorable manner together with the piping.

In the context of the present invention, it can be provided, in particular, to first pass the first sump liquid through a corresponding supercooling counter-flow heat exchanger, independently of whether it is arranged in a further cold box or not, and then feed it into the fourth separating unit at a first feed position. Furthermore, it can be provided, in the vicinity, preferably directly below the feed position of a liquid feed air stream into the first separating unit, to withdraw a liquid stream of material from the first separating unit, to pass it through the supercooling counter-flow heat exchanger, and to feed it into the fourth separating unit at a second feed position. The second feed position into the fourth separating unit is advantageously above the first feed position into the fourth separating unit and is advantageously separated from the latter by at least one separating section.

In the context of the present invention, in particular a liquid air product can be removed from the distillation column system, pressure-increased in the liquid state, converted into the gaseous or supercritical state by heating, and discharged from the air separating installation. The present invention can therefore be used in particular in connection with what is known as internal compression of air products. For details on internal compression methods, reference is made to the cited prior art.

In the context of the present invention, further streams of material can be removed from the distillation column system and provided as air products. In particular, a gaseous stream of material can be removed from the fourth separating unit, passed through the supercooling counter-flow heat exchanger, and conducted out of the distillation column system as what is known as impure nitrogen. A removal point from the fourth separating unit is advantageously above the second feed position into the fourth separating unit. Furthermore, in the context of the present invention, a liquid stream of material can be removed in an upper region of the fourth separating unit and provided as a liquid nitrogen product. It is furthermore also possible to remove a gaseous, nitrogen-rich stream in an upper region of the fourth separating unit, to pass it through the supercooling counter-flow heat exchanger and to provide it as a corresponding low-pressure nitrogen product.

The invention also extends to an air separating installation having a distillation column system comprising a first separating unit, a second separating unit, a third separating unit, and a fourth separating unit, as indicated in the corresponding independent claim.

The air separating installation according to the invention, which is advantageously set up to perform a method as explained above, benefits in the same way from the advantages of the method according to the invention in its explained embodiments. Reference is therefore explicitly made to the explanations above.

BRIEF DESCRIPTION OF THE DRAWINGS

FIG. 1 illustrates a distillation column system of an air separating installation in accordance with an embodiment of the present invention in a partial representation.

DETAILED DESCRIPTION OF THE DRAWINGS

FIG. 1 shows a distillation column system of an air separating installation set up for operation according to one embodiment of the present invention in a greatly simplified partial representation. The distillation column system illustrated in FIG. 1 is designated as a whole with 100. It is provided in an air separating installation 200 which is only indicated here.

The components of the distillation column system 100 illustrated in FIG. 1 comprise a first separating unit 110, a second separating unit 120, a third separating unit 130, and a fourth separating unit 140, a main condenser 150, a supercooling counter-flow heat exchanger 160, a transfer pump 170, an internal compression pump 180, and a head condenser 190.

The first separating unit 110 corresponds to a high-pressure column of a conventional air separating installation. The first separating unit is operated at a corresponding pressure level, referred to herein as the "first pressure level." The second separating unit 120 and the fourth separating unit 140 correspond to a first section and a second section of a low-pressure column of a conventional air separating installation. They are operated at a corresponding common pressure level, referred to herein as the "second pressure level." The third separating unit 130 represents an argon discharge column. It is also operated at the second pressure level.

In the distillation column system 100 illustrated in FIG. 1, the first separating unit 110 and the second separating unit 120 are in heat-exchanging connection via the main condenser 150, as also explained below. Furthermore, the first separating unit 110 and the second separating unit 120 are arranged in particular within a common column jacket and, in the sense explained above, one above the other, in particular one directly above the other. The head condenser 190 is arranged at the upper end of the third separating unit 130. In the alternative illustrated here, the third separating unit (130) opens in a lower region with respect to an upper region of the second separating unit (120). However, it is alternatively also possible for the third separating unit (130) to be connected to the second separating unit (120) via pipelines which run between an upper region of the second separating unit (120) and a lower region of the third separating unit (130). This is not illustrated separately.

With regard to further explanations regarding an air separating installation, of which the distillation column system 110 may be a part, reference is made to relevant technical literature, e.g., Haring (see above), in particular chapter 2.2.5 and FIG. 2.3A. In such an air separating installation, in particular a gaseous feed air stream 1 and a liquefied feed air stream 2 can be provided. In this connection, in particular a main air compressor, cleaning and preparation devices, turbines, expansion valves, and a main heat exchanger of a known type can be used.

The feed air streams 1 and 2 are fed into the first separating unit 110 at feed positions 111 and 112, respectively. In the first separating unit 110, an oxygen-enriched, nitrogen-depleted, argon-containing sump liquid and a nitrogen-enriched, oxygen-depleted head gas are formed at the first pressure level. The sump liquid is withdrawn from the first separating unit 110 in the form of a stream of material 3. The head gas is withdrawn from the first separating unit 110 in the form of a stream of material 4. Directly below the feed position 112 for the feed air stream 2, liquid in the form of a stream of material 5 is conducted out of the first separating unit 110.

The stream of material 3 is passed through the supercooling counter-flow heat exchanger 160 and partially fed in the form of a stream of material 31 into the fourth separating unit 140 at a feed position 141. Another part is transferred in the form of a stream of material 32 into an evaporation chamber of the head condenser 190. A liquid stream of material 33 and a gaseous stream of material 34 are withdrawn from the evaporation chamber of the head condenser 190 and likewise fed into the fourth separating unit 140, in particular at different heights. The stream of material 4 is also divided into two substreams 41 and 42. The first substream 41 is partially or completely liquefied in the main condenser 150. A first fraction 411 of the first substream 41 is returned as a return flow to the first separating unit 110 at a feed position 113. A second fraction 412 of the first substream 41 is passed through the supercooling counter-flow heat exchanger 160 and guided as a return flow to the fourth separating unit 140. The substream 42 is conducted out of the distillation column system 100 as a gaseous pressurized nitrogen product. The stream of material 5 is passed through the supercooling counter-flow heat exchanger 160 and fed into the fourth separating unit 140 at a feed position 142.

An oxygen-rich sump liquid and an argon-enriched head gas are formed in the second separating unit 120. The sump liquid is withdrawn from the second separating unit 120 in the form of a stream of material 6. A first substream 61 of the stream of material 6 is pressure-increased in the internal compression pump 180 in the liquid state, converted into the gaseous or supercritical state by heating (not separately illustrated in FIG. 1), and conducted out as an internally compressed pressurized oxygen product. A second substream 62 of the stream of material 6 is provided as a liquid oxygen product after partially passing through the supercooling counter-flow heat exchanger 160 and corresponding tempering.

The head gas of the second separating unit 120 rises partly into the third separating unit 130, which is arranged above the second separating unit 120 and which opens in a lower region, in particular without a cross-sectional tapering toward the second separating unit 120. Another part of the head gas is withdrawn in the form of a stream of material 7. The stream of material 7 is fed a lower region of the fourth separating unit 140 at a feed position 143.

In the third separating unit 130, a head gas containing at least the predominant part of the argon previously contained in the feed air supplied to the distillation column system 100 is formed. This head gas from the third separating unit 130 is withdrawn in the form of a stream of material 8. Liquid which trickles down from the third separating unit 130 and is in this way depleted of argon or is (substantially) free of argon, directly reaches the second separating unit 120 again. An argon discharge therefore occurs in the third separating unit 130.

A sump liquid and a head gas are formed in the fourth separating unit 140. The sump liquid is withdrawn from the fourth separating unit 140 in the form of a stream of material 9 and is returned by means of the transfer pump 170 to the second separating unit 120 as a return flow and is in this case fed into the second separating unit 120 at a feed position 114. A stream of material 10, known as impure nitrogen, is removed from the fourth separating unit, passed through the supercooling counter-flow heat exchanger 160, and conducted out of the distillation column system 100. The same applies to a nitrogen-rich stream of material 11 which is provided as a gaseous low-pressure nitrogen product. Nitrogen-rich liquid in the form of a stream of material 12 is withdrawn from a liquid retention device at the head of the fourth separating unit (140) and provided as a liquid nitrogen product. If no gaseous low-pressure nitrogen product is required, a corresponding separating section in the fourth separating unit 14 can be omitted and all the head gas can be withdrawn as impure nitrogen corresponding to the stream of material 10.

As illustrated here but not mandatory for the present invention, the first separating unit 110, the second separating unit 120, and the third separating unit 130 on the one hand and the fourth separating unit 140 on the other hand are each provided in a cold box A and B, respectively, and are connected to one another and/or to one another to further apparatuses, such as the supercooling counter-flow heat exchanger 160 and the main heat exchanger not shown, by means of lines or piping, denoted together here by 20. The piping extends vertically at least in sections. At least a part of such piping 20 can be arranged separately from the two cold boxes A and B, in which the first separating unit 110, the second separating unit 120, and the third separating unit 130 on the one hand and the fourth separating unit 140 on the other hand are arranged, in an additional cold box C. This additional cold box C for the piping may also contain, in particular, the supercooler 160.

The invention claimed is:

1. An air separating installation comprising:

a distillation column system (100) that has a first separating unit (110), a second separating unit (120), a third separating unit (130), and a fourth separating unit (140), wherein the air separating installation is set up to feed compressed and cooled air into the first separating unit (110), to operate the first separating unit (110) at a first pressure level of 4 to 9 bar of absolute pressure, to operate the second separating unit (120), the third separating unit (130), and the fourth separating unit (140) at a second pressure level of 1 to 3 bar of absolute pressure, to form an oxygen-enriched, nitrogen-depleted, argon-containing first sump liquid and a nitrogen-enriched, oxygen-depleted first head gas by means of the first separating unit (110), to transfer the first sump liquid partially or completely into the fourth separating unit (140), to partially or completely liquefy the first head gas and to return it to the first separating unit (110), to form an oxygen-rich second sump liquid and an argon-enriched second head gas by means of the second separating unit (120), to transfer a first fraction of the second head gas into the third separating unit (130) and a second fraction of the second head gas into the fourth separating unit (140), to partially or completely separate off the argon which is contained in a quantity of air supplied overall to the distillation column system (100) by means of the third separating unit (130), to provide a liquid return flow to the second separating unit (120) by means of the third separating unit (130), to form a fourth sump liquid and a fourth head gas by means of the fourth separating unit (140), and to return the fourth sump liquid at least partially to the second separating unit (120), wherein the second separating unit (120) has 10 to 50 theoretical plates, the third separating unit (130) has 10 to 60 theoretical plates, that the third separating unit (130) is arranged above the second separating unit (120), that the fourth separating unit (140) is arranged adjacent to the first separating unit (110), and that the third separating unit (130) opens in a lower region with respect to an upper region of the second separating unit (120), or the third separating unit (130) is connected to the second separating unit (120) via pipelines which run between an upper region of the second separating unit (120) and a lower region of the third separating unit (130).

2. The installation according to claim 1, in which a lower termination of the fourth separating unit (140) is arranged no more than eight meters above a lower termination of the first separating unit (110).

3. The installation according to claim 1, wherein the compressed and cooled feed air which is fed into the first separating unit comprises a gaseous and a liquefied feed air stream (1, 2).

4. The installation according to claim 1, in which the first separating unit (110) and the second separating unit (120) are arranged within a common column jacket or in two column jackets that are structurally connected to one another, wherein the common column jacket or the column jacket of the second separating unit (120) is structurally connected to the third separating unit (130).

5. The installation according to claim 1, in which the fourth separating unit has 18 to 55 theoretical plates.

6. The installation according to claim 1, in which the first fraction of the second head gas comprises 20 to 60 volume percent and the second fraction of the second head gas comprises 40 to 80 volume percent of the second head gas, wherein the total volume of the first fraction of the second head gas and the second fraction of the second head gas does not exceed 100 volume percent of the second head gas.

7. The installation according to claim 1, in which the fourth sump liquid is returned to the second separating unit (120) using a transfer pump (170) or using two or more transfer pumps arranged in parallel.

8. The installation according to claim 1, in which the first separating unit (110), the second separating unit (120), and the third separating unit (130) are arranged in a common cold box (A).

9. The installation according to claim 8, in which the fourth separating unit (140) is arranged in the common cold box (A) or a further cold box (B).

10. The installation according to claim 9, in which the first separating unit (110), the second separating unit (120), the third separating unit (130), and the fourth separating unit (140) are connected to one another and/or to further apparatuses by means of piping (20) which runs vertically in sections, wherein at least a part of the piping (20) is arranged in a separate piping cold box (C).

11. The installation according to claim 10, in which a supercooler (120) is also arranged in the piping cold box (C).

12. The installation according to claim 9, in which the first separating unit (110), the second separating unit (120), and the third separating unit (130) are connected to one another and/or to one another to further apparatuses by means of piping (20) which runs vertically in sections, wherein at least a part of the piping (20) is arranged in a separate piping cold box (C).

13. The installation according to claim 12, in which a supercooler (120) is also arranged in the piping cold box (C).

14. The installation according to claim 1, in which a liquid air product is removed from the distillation column system (100), pressure-increased in the liquid state, converted into the gaseous or supercritical state by heating, and discharged from the air separating installation.

15. A method for low temperature separation of air using an air separating installation according to claim 1, said method comprising:

feeding compressed and cooled feed air into the first separating unit (110), wherein said oxygen-enriched, nitrogen-depleted, argon-containing first sump liquid and said nitrogen-enriched, oxygen-depleted first head gas are formed by means of the first separating unit (110), partially or completely transferring the first sump liquid into the fourth separating unit (130), partially or completely liquefying the first head gas and returning the partially or completely liquefied first head gas to the first separating unit (110), forming said oxygen-rich second sump liquid and said argon-enriched second head gas by means of the second separating unit (120), transferring said first fraction of the second head gas into the third separating unit (130) and transferring said second fraction of the second head gas into the fourth separating unit (140), partially or completely separated off argon contained in the feed air supplied to the distillation column system by means of the third separating unit (130) to provide said liquid return flow, introducing said liquid return flow from the third separating unit (130) into the second separating unit (120), and forming said fourth sump liquid and said fourth head gas by means of the fourth separating unit (140), and partially or completely returning the fourth sump liquid to the second separating unit (120), wherein the first separating unit (110) is operated at a first pressure level of 4 to 9 bar of absolute pressure, and the second separating unit (120), the third separating unit (130), and the fourth separating unit (140) are operated at a second pressure level of 1 to 3 bar of absolute pressure.

16. The method according to claim 15, in which a lower termination of the fourth separating unit (140) is arranged no more than eight meters above a lower termination of the first separating unit (110).

17. The method according to claim 15, wherein the compressed and cooled feed air which is fed into the first separating unit comprises a gaseous and a liquefied feed air stream (1, 2).

18. The method according to claim 15, in which the first separating unit (110) and the second separating unit (120) are arranged within a common column jacket or in two column jackets that are structurally connected to one another, wherein the common column jacket or the column jacket of the second separating unit (120) is structurally connected to the third separating unit (130).

19. The method according to claim 15, in which the fourth separating unit has 18 to 55 theoretical plates.

20. The method according to claim 15, in which the first fraction of the second head gas comprises 20 to 60 volume percent and the second fraction of the second head gas comprises 40 to 80 volume percent of the second head gas, wherein the total volume of the first fraction of the second head gas and the second fraction of the second head gas does not exceed 100 volume percent of the second head gas.

21. The installation according to claim 1, in which the first fraction of the second head gas comprises 20 to 50 volume percent and the second fraction of the second head gas comprises 50 to 80 volume percent of the second head gas, wherein the total volume of the first fraction of the second head gas and the second fraction of the second head gas does not exceed 100 volume percent of the second head gas.

22. The method according to claim 15, in which the first fraction of the second head gas comprises 20 to 50 volume percent and the second fraction of the second head gas comprises 50 to 80 volume percent of the second head gas, wherein the total volume of the first fraction of the second head gas and the second fraction of the second head gas does not exceed 100 volume percent of the second head gas.

* * * * *